United States Patent [19]

Maeder

[11] 4,179,909

[45] Dec. 25, 1979

[54] DOMER ASSEMBLY FOR IRONING MACHINE

[75] Inventor: Edward G. Maeder, Minnetonka, Minn.

[73] Assignee: National Can Corporation, Chicago, Ill.

[21] Appl. No.: 900,270

[22] Filed: Apr. 26, 1978

[51] Int. Cl.[2] ..... B21B 45/02; B21D 22/00

[52] U.S. Cl. ..... 72/45; 72/349; 72/467

[58] Field of Search ..... 72/347, 348, 349, 467, 72/344, 44, 45

[56] References Cited

U.S. PATENT DOCUMENTS

| | | | |
|---|---|---|---|
| 3,664,171 | 5/1972 | Paramonoff | 72/349 |
| 3,771,345 | 11/1973 | Paramonoff | 72/349 |
| 3,967,482 | 7/1976 | Kubacki | 72/349 |

*Primary Examiner*—Leon Gilden

*Attorney, Agent, or Firm*—Robert A. Stenzel; Ralph R. Rath

[57] ABSTRACT

A domer assembly which cooperates with the punch of a drawing and ironing machine to reform an end wall of a container includes a support that has a flat supporting surface defined in the bottom of a recess and a carrier element having a cooperating surface engaging the flat bottom surface. A domer element is supported on the carrier element and both are movable as a unit radially of the path of movement of the punch and are normally centered with respect to the axis of the punch through biasing springs which will accommodate radial movement. The assembly also includes means for supplying air between the surfaces to act as a fluid bearing and reduce friction.

10 Claims, 2 Drawing Figures

14
28
10
20
12
29
25
22
22
24
P
26

DOMER ASSEMBLY FOR IRONING MACHINE

BACKGROUND OF THE INVENTION

The present invention relates generally to ironing machines and more specifically to an improved domer support assembly for such a machine.

In the formation of a "two-piece" container, a flat circular disc is normally transformed into a shallow cup using a cupping machine. The cup is then transferred to a bodymaker wherein the cup is converted into a finished container. The last step in producing the finished container consists of reforming the integral end wall of the container shell to increase the resistance of the container to internal pressures that are subsequently encountered when the container is utilized for packaging pressurized products.

One type of machine that has been utilized for producing containers of the above type is produced by Ragsdale Bros., Inc. and is identified as a Model CR-24 can wall drawing and ironing press. This machine includes a plurality of cooperating axially spaced die assemblies that cooperate with an axially movable punch to convert a cup into a finished drawn and ironed container. At the end of the stroke for the punch, the free end of the punch cooperates with a domer assembly for producing the final configuration of the integral end wall of the container. Usually such end wall configuration is domed inwardly as, for example, is shown in U.S. Pat. No. 3,942,673.

One of the problems that has been encountered is the misalignment with the free end of the punch and the domer or reforming member as the end wall is being reformed. It will be appreciated that the domer member must be spaced from the drawing and ironing die assemblies by a dimension which is greater than the axial length of the can so that the stripper ring positioned adjacent the die assemblies will be located above the free edge of the container to assist in removing the container from the punch or ram during the return stroke thereof. Thus, the domer element must be supported by as much as 6 inches away from the stripper assembly and this substantial spacing produces problems in maintaining an accurate alignment between the axis of the punch and the center of the domer member. If either of these members are misaligned by even a small dimension, defects occur in the reformed end wall, such as sharp indentations along one side of the inner edge of the end wall adjacent the sidewall thereof. This might in turn reduce the strength of the end wall even though the defects may not be visible.

It has also been determined that, when cups are initially misfed or defective cups are received in the drawing and ironing machine, the cups will be crushed by the punch during its movement through the redraw and ironing rings. In many instances, the crushed cup covers only a portion of the punch and will force the punch out of alignment with the center of the domer. Thus, the exposed portion of the punch may be damaged when it bottoms out on the domer. Also, many times the metal fragments are deposited on the domer which can also cause damage to the punch, particularly when the punch is formed from carbide material.

SUMMARY OF THE INVENTION

According to the present invention, a domer assembly which cooperates with a punch of an ironing machine to reform the end wall of an ironed container includes a support that has a recess with the base of the recess defining a support surface. A carrier element is located in the recess and has a cooperating surface which engages the bottom of the recess and both the carrier and the recess in the support are circular with the recess being enlarged so as to accommodate movement of the carrier element in all directions along a plane which extends perpendicular to the path of movement of the punch.

The domer assembly also includes supply means for introducing a bearing fluid between the two surfaces with biasing means between the support and the carrier element which normally maintain the surfaces in a predetermined position with respect to each other and accommodate radial movement of the carrier element within the recess. The biasing means or springs are positioned such that the domer member or element supported on the carrier is always returned to the predetermined position whenever external forces are removed from the assembly.

According to one aspect of the invention, the support also includes prestressing means for prestressing the springs located between the support and the carrier element so that the carrier element is always returned to a predetermined position with respect to the path or axis of the punch regardless of variations in spring forces being applied by the respective springs.

The prestressing means consists of a ring which surrounds a reduced portion of the carrier element and is spaced therefrom but is fixedly secured in a predetermined position with respect to an enlarged portion of the carrier element. The springs, which are equally spaced circumferentially around the periphery of the reduced portion, are biased into engagement with the inner surface of the positioning ring and also engage a sidewall of a reduced portion of the recess.

With this arrangement, the springs always are pretensioned to produce a predetermined centering force and, when the domer is moved off-center with respect to the axis of the punch, only one or two of the springs will be further compressed while the remaining springs remain in the prestressed condition. This insures that the carrier element and domer element supported thereon are always moved to a predetermined accurately positioned centered position with respect to the axis of the punch.

DETAILED DESCRIPTION

Figure 1:
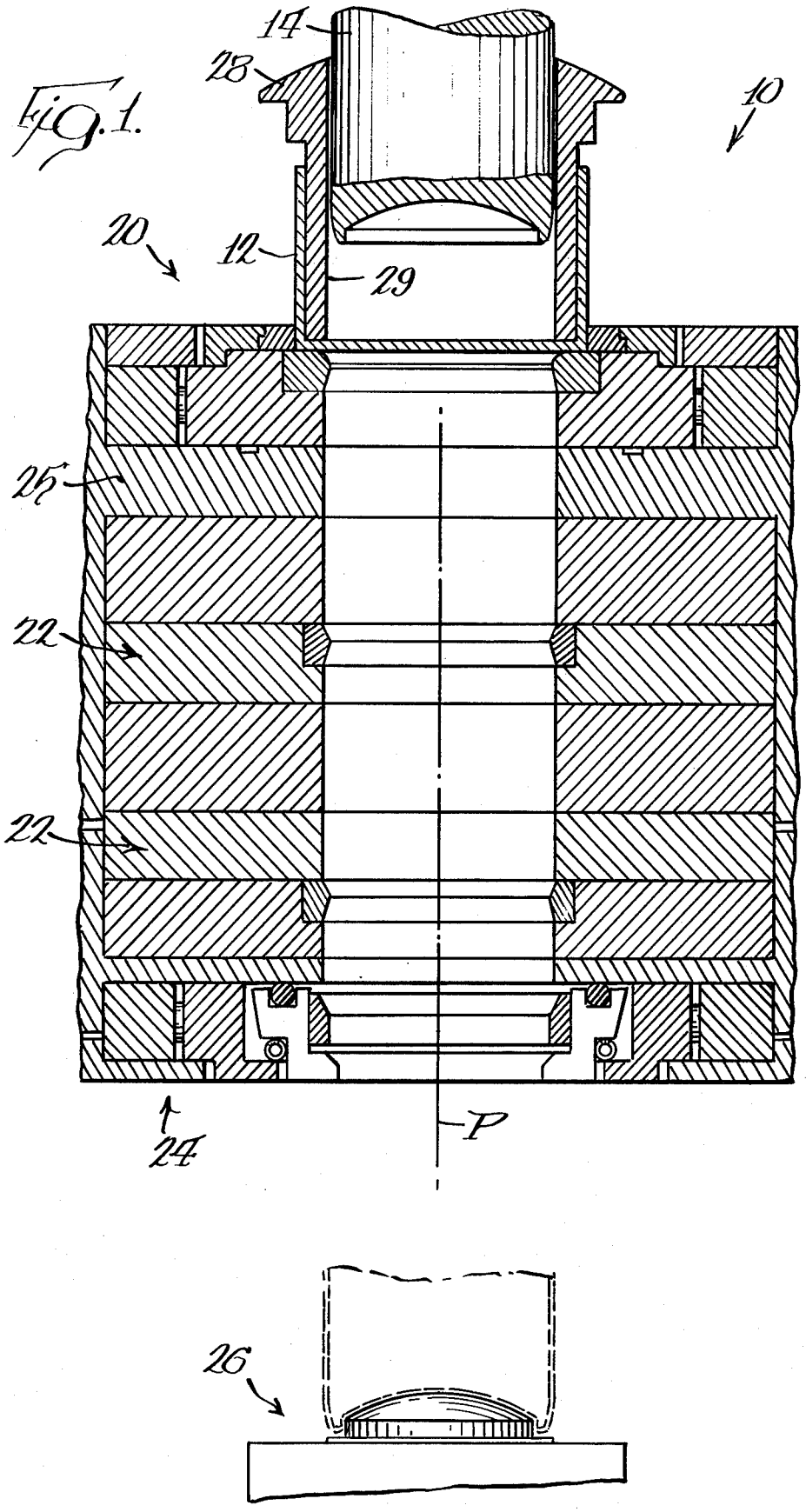
FIG. 1 of the drawings schematically illustrates a fragmentary sectional view of a drawing and ironing machine into which the present invention can be incorporated.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings schematically illustrates selected portions of a bodymaker 10 used for converting a cup 12 into a finished drawn and ironed container. Bodymaker 10, which may be a Ragsdale type machine identified above, includes a punch 14 which is supported on a press ram (not shown) and is moved along a predetermined path or axis P and is supported on a frame of the bodymaker or press. The axis or path P for punch 14 has a plurality of assemblies located at axially spaced positions including a redraw assembly 20, a pair of ironing assemblies 22 and a stripper assembly 24. Assemblies 20, 22 and 24 are all supported in a frame structure 25 which may be part of the main frame of the press or may be a separate cartridge unit fixedly supported with respect to the remainder of the press. A domer assembly 26 is spaced from the stripper assembly by a dimension which is greater than the height of the can as will be described later. The bodymaker or press 10 also includes a cup holder sleeve 28 which cooperates with redraw assembly 20 and with punch 14, as will be subsequently described.

Before the stroke of punch 14 and cup holder sleeve 28 is initiated, a cup 12 is generally aligned with redraw assembly 20 through a cup locating mechanism (not shown) and cup holder sleeve 28 is then moved to the position illustrated in FIG. 1 to hold cup 12 in a fixed position with respect to redraw assembly 20. Punch 14 is then moved axially through a bore 29 in cup holder sleeve 28 to force the cup through the opening in the redraw assembly 20 wherein the cup diameter is decreased and the cup height is increased. Continued movement of punch 14 along path P will force the cup through the openings in the plurality of ironing assemblies 22 to reduce the sidewall thickness of the cup. After the cup has been passed through the respective assemblies 20 and 22 and through stripper assembly 24, the lower end of the punch, which is generally dome shape in cross section, cooperates with domer assembly 26 to reform the bottom wall of the cup and produce a finished container. During the return stroke of punch 14, stripper assembly 24 engages the upper free edge of the finished container to strip the container from the punch.

As was indicated above, one of the problems in producing satisfactory containers utilizing a process such as that described above, is to maintain extremely accurate alignment between the axis of punch 14 and the center or axis of domer assembly 26. Any misalignment of these two elements with respect to each other by even a small increment will result in a defect in the end wall of the container which in turn will impair the strength of the container.

According to the present invention, the domer assembly 26 is constructed in such a fashion that the domer element which forms part of the assembly can readily be moved in any direction radially of the axis or path P to move into a position in exact alignment with the center of punch 14 should the punch be offset from the path for any reason. For this purpose, domer assembly 26 (FIG. 2) consists of a support 30 which may be accurately positioned with respect to the remainder of the frame structure of the bodymaker 10 and is supported on a cushion such as air, for axial movement (not shown). Support 30 has a recess or opening 32 extending from the upper surface 34 and recess 32 has an enlarged portion 36 and a reduced portion 38 with a generally flat bottom wall or surface 40 defined in the reduced portion 38. The center of circular opening 32 is accurately positioned and centered with respect to path P.

Domer assembly 26 also includes a support element or member 42 which has an enlarged portion 44 received into enlarged portion 36 of recess 32 and a reduced portion 46 with reduced portion 46 having a bottom surface 48 which is in extended engagement with bottom wall or surface 40 of recess 32. Recess 32 and carrier element 42 are both circular in cross section and carrier element 42 is smaller in dimension than the recess 32, as will be described later.

The remainder of domer assembly 26 consists of a domer element or tool 50 which is supported in an opening 52 in carrier element 42 and is secured thereto by a bolt 54. The threaded bolt or stud 54 extends through an opening 56 in carrier element 52 and is threaded into an opening in the domer element 50 so that the carrier element 42 and domer element 50 move as a unit in a radial direction with respect to path P.

The domer assembly also includes biasing means 60 between support 30 and carrier element 42. Biasing means 60 consists of four or more circumferentially equally spaced spring assemblies that each consist of a spring 62 having one end received into a cup 64 which is reciprocated in a bore 66 in carrier element 42 and the opposite end received into a reduced portion of bore 66. The inner end of each cup 64 is received into the enlarged portion of bore 66 and is biased into engagement with the sidewall of the reduced portion 38 of recess 32. Thus, the four or more spring assemblies will always maintain the domer assembly, particularly domer element 50, in a predetermined position with respect to the axis or path P. However, should the axis of punch 14 be slightly offset from the path P, the various spring assemblies will allow carrier element 42 and domer element 50 to move radially with respect to the punch and to accurately align itself with the axis of the punch to produce a satisfactory finished container having a reformed end wall of any particular configuration.

According to another aspect of the invention, domer assembly 26 also includes prestressing means cooperating with the respective spring assemblies for insuring that the domer element 50 is always moved to a same exact centered position with respect to path P when the external forces are removed. For this purpose, a circular or annular ring 70 extends around and is spaced from the periphery of the reduced portion 46 of support carrier 42 and cooperates with the respective spring assemblies to maintain all of the springs in a certain prestressed condition at all times. Ring 70 is accurately positioned with respect to carrier element 42 by a cooperating offset portion 72 and a recess 74 respectively defined on the ring 70 and carrier element 42. Ring 70 is releasably secured to carrier element 42 through a plurality of threaded studs 76.

Figure 2:
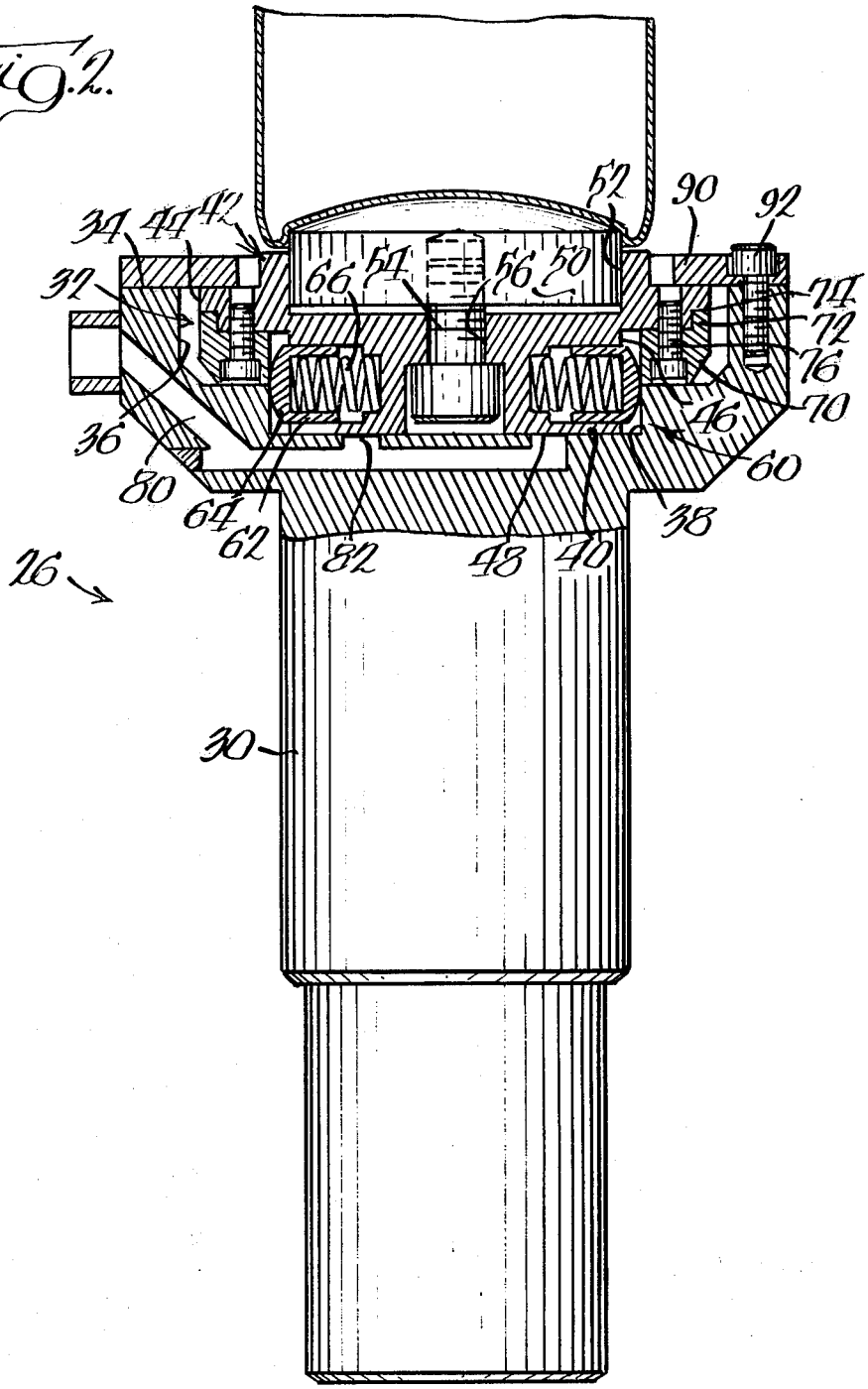
FIG. 2 is an enlarged side elevation view with parts thereof broken away illustrating the domer assembly of the present invention.

With this arrangement, the various springs 62 and cups 64 can be positioned into openings 66 and ring 70 can then be telescoped to the position illustrated in FIG. 2 and secured to carrier element 42 through bolts or studs 76. The outer free edge of each of the cups, which is generally spherically shaped, thus cooperates partially with the inner surface of ring 70 to maintain all of the springs in a prestressed condition, regardless of variations in spring force. If there is a need for the carrier element to move radially with respect to path P, only a certain number of spring assemblies, less than all, are further compressed while the remainder of the spring assemblies remain in the same prestressed condition. Thus, when an external force is removed, after the carrier assembly has been moved off its normally centered position, there is no interference by certain springs preventing the carrier element 42 and domer 50 from moving to the predetermined centered position.

According to a further aspect of the invention, domer assembly 26 also includes fluid means for supplying a bearing fluid between surfaces 40 and 48 of carrier element 42 and support 30. This fluid supply consists of a bore 80 extending through support 30 and in communication at its inner end with an annular recess or opening 82 that extends from surface 40. A pressurized fluid suppy, such as air, is attached to the outer end of bore 80 and supplies a constant flow of air to annular recess 82 which must then flow between bearing surfaces 40 and 48 which results in a fluid bearing between the surfaces. Such arrangement reduces the frictional forces encountered when carrier element 42 is attempted to be moved radially of path P.

As can be appreciated from the above description, the fluid bearing between surfaces 40 and 48 will always tend to move carrier element upwardly and for this purpose, an annular cover 90 extends across the peripheral portion of recess 32 and the peripheral portion of carrier element 42 and is held in position by threaded studs 92 to hold the assembly in the position illustrated in FIG. 2. However, radial movement is accommodated through the centering springs 62. While four centering springs have been illustrated, three or more springs equally spaced around the perimeter of carrier 42 will produce the centering function.

I claim:

1. A domer assembly for use with a punch of an ironing machine to reform the end wall of an ironed container comprising a support having a recess with the base of the recess defining a support surface, a carrier element received in said recess and having a cooperating surface engaging said surface, said carrier element having a peripheral dimension which is less than the peripheral dimension of said recess, a domer element on said carrier element, means for supplying a bearing fluid between said surfaces, and biasing means between said support and carrier element normally maintaining said surfaces in a predetermined position with respect to each other and accommodating movement of said carrier element in all directions within said recess.

2. A domer assembly as defined in claim 1, in which the periphery of said recess and carrier element are circular.

3. A domer assembly as defined in claim 2, in which said recess has an enlarged portion at a surface of said support and a reduced portion at the base thereof with said support surface being a flat surface at the base of said reduced portion and in which said carrier element has corresponding enlarged and reduced portions, further including means for supplying fluid between said support surface and said cooperating surface.

4. A domer assembly as defined in claim 3, in which said fluid is air and said means includes an annular recess defined in said support surface.

5. A domer assembly as defined in claim 3, further including an annular cover overlying a peripheral portion of said carrier element and said recess and releasably secured to said support.

6. A domer assembly as defined in claim 5, in which said biasing means includes a plurality of at least three equally circumferentially spaced springs between said reduced portions of said recess and said carrier element.

7. A domer assembly as defined in claim 6, further including means for maintaining said springs in a prestressed condition at all times.

8. In an ironing machine for producing an ironed container having a sidewall and integral end wall including: a fixed frame, a punch movable along a predetermined axis on said frame, a plurality of axially spaced die assemblies on said frame and cooperating with said punch for reducing sidewall thickness of said sidewall and circular reforming member located along said axis and cooperating with a free end of said punch for reforming said end wall, and support means for said reforming member, the improvement of said support means including a support carried by said frame and having a circular recess aligned with said axis with said recess having a flat bottom wall extending radially of said axis and a sidewall, a carrier element received in said recess and having a flat surface engaging said flat bottom wall with said circular reforming member supported on said carrier element, and spring means normally maintaining said reforming member and carrier element centered with respect to said axis and accommodating relative radial movement of said carrier element with respect to said recess.

9. An ironing machine as defined in claim 8, further including means for supplying a fluid medium between said bottom wall and said flat surface.

10. An ironing machine as defined in claim 8, in which said spring means includes at least three circumferentially spaced springs and further including means cooperating with said springs for returning said reforming die to a centered position regardless of variations in spring force from said plurality of springs.

* * * * *